US012637808B2

(12) United States Patent
Spencer et al.

(10) Patent No.: US 12,637,808 B2
(45) Date of Patent: May 26, 2026

(54) MOISTURE MANAGEMENT TO CONTROL PARTICLE SIZE DISTRIBUTION IN SHREDDED WASTE MATERIALS

(71) Applicant: Continuus Materials Intellectual Property, LLC, The Woodlands, TX (US)

(72) Inventors: Matthew Spencer, Palatine, IL (US); Marko Suput, Lompoc, CA (US); Jack G. Winterowd, Puyallup, WA (US); Mya Fisher, Ames, IA (US)

(73) Assignee: Continuus Materials Intellectual Property, LLC, The Woodlands, TX (US)

( * ) Notice: Subject to any disclaimer, the term of this patent is extended or adjusted under 35 U.S.C. 154(b) by 528 days.

(21) Appl. No.: 18/298,648

(22) Filed: Apr. 11, 2023

(65) Prior Publication Data

US 2024/0218596 A1 Jul. 4, 2024

Related U.S. Application Data

(60) Provisional application No. 63/437,038, filed on Jan. 4, 2023.

(51) Int. Cl.
*D21F 7/00* (2006.01)
*D21F 5/00* (2006.01)

(52) U.S. Cl.
CPC ..... *D21F 7/003* (2013.01); *D21F 5/00* (2013.01)

(58) Field of Classification Search
None
See application file for complete search history.

(56) References Cited

FOREIGN PATENT DOCUMENTS

WO WO-2019/094411 A2 * 5/2019

OTHER PUBLICATIONS

Foreign Search Report on EP Dtd Jun. 7, 2024.

* cited by examiner

*Primary Examiner* — Mohammad M Ameen
(74) *Attorney, Agent, or Firm* — FOLEY & LARDNER LLP

(57) ABSTRACT

A method of generating paper and plastic fragments includes measuring a moisture content of a batch of paper and plastic material, drying the batch of paper and plastic material to achieve a target moisture content, and disintegrating the batch of paper and plastic material, after drying, to form a plurality of paper and plastic fragments.

14 Claims, 8 Drawing Sheets

MOISTURE MANAGEMENT TO CONTROL PARTICLE SIZE DISTRIBUTION IN SHREDDED WASTE MATERIALS

CROSS-REFERENCE TO RELATED PATENT APPLICATIONS

This application claims the benefit of U.S. Provisional Patent Application No. 63/437,038, filed on Jan. 4, 2023, the entirety of which is hereby incorporated by reference herein.

BACKGROUND

Effective and environmentally sound waste disposal is a common dilemma faced by most industrialized and developing nations. In recent history, waste has primarily been disposed of in landfills, which require substantial tracts of land that might otherwise be used for other meaningful purposes. Regulatory and political bodies, as well as generators of waste, are increasingly interested in reducing waste volumes, diverting waste from landfills and incinerators while promoting more sustainable usage of waste products. Unfortunately, despite efforts of governments and communities to institute and promote waste recycling programs, there remains a tremendous amount of recyclable material that is not recycled.

There is a critical need to utilize this vast resource and at the same time save the land now occupied as landfill space. It is therefore desirable to develop technologies that not only reduce the amount of waste destined for a landfill or incinerator, but also to capture and use such material for beneficial purposes

Figure 1:
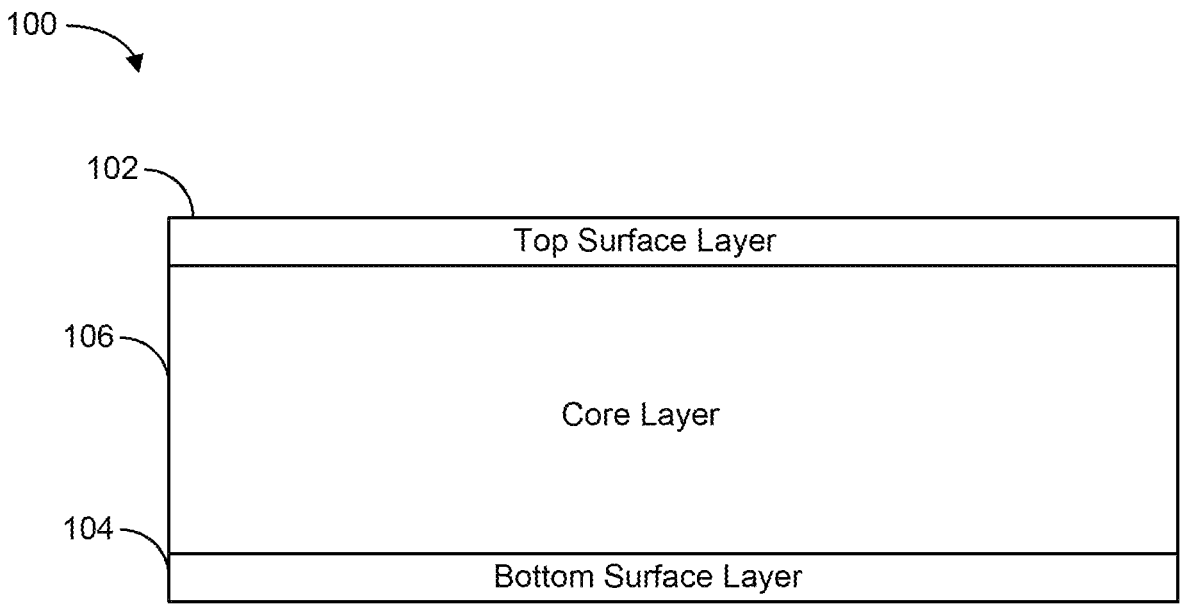
FIG. 1 is an example composite mat, in accordance with some embodiments of the present disclosure.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Current solutions to reducing the amount of waste stored in landfills or burned in incinerators often involve converting the waste into a useful product. For instance, in one example, the waste may be captured, melted, and congealed into a composite board comprising a mixture of the captured waste. If the composite board is properly melted and congealed, the composite board may be capable of being exposed to outdoor elements (e.g., sun, rain, snow, sleet, temperature changes, heat, cold, etc.) for prolonged time periods without any substantial deformations. Construction companies may use such composite boards to build roofing and/or side paneling for houses or large buildings. Thus, instead of taking up space in landfills that are increasingly overflowing, waste may be manipulated by manufacturers into a composite board that can benefit many different types of consumers (e.g., homeowners, companies working in offices, warehouse owners, etc.).

One sample process for manufacturing composite boards is described in U.S. patent application Ser. No. 17/069,567, filed Oct. 13, 2020, the entirety of which is incorporated by reference herein. This process generally involves forming a mat comprised of fragments. In some cases, the fragments are a mixture of discrete paper fragments (e.g., cellulosic fragments) and/or plastic fragments (e.g., thermoplastic polymer fragments). In other cases, each fragment is comprised of separate layers of paper and thermoplastic polymer. The mat may include paper/plastic fragments sandwiched between top and bottom layers (e.g., facer layers). These top and bottom layers may include paper, fiberglass, films, and/or other nonwovens or facer fabrics. Typically, thermoplastic adhesive layers are positioned between the paper/plastic fragment-based core and the top and bottom surface layers. The mat may be assembled in a relatively cold state and the spatial order of the components may be mostly preserved throughout the subsequent thermal processing steps. The moisture content of the mat can range from about 0 percent to about 25 percent. The mat is first subjected to a hot-pressing step under conditions that compress the mat and melt a significant portion of the thermoplastic polymer, especially fragments made of polyethylene. In a subsequent step, the hot mat may be subjected to a cold-pressing step under conditions that simultaneously maintain the compressed state of the mat and congeal (e.g., freeze) the molten thermoplastic in the mat. In some systems, a mat of paper and plastic may be continuously deposited onto a moving conveyor belt and moved through a continuous hot press. The hot press may include continuous heated belts, usually made of steel, above and below the mat that are heated to temperatures as high as 480 degrees Fahrenheit. The continuous steel belts may move at approximately the same speed as a conveyor belt such that the mat of paper and plastic is continuously fed into and pressed by the heated belts.

The raw paper and plastic used to produce the fragments in the mat may be provided from various sources, including municipal waste streams, post-consumer materials, and post-industrial materials. The paper and plastic supplied in these streams may be subject to high variability in moisture content. For example, a municipal waste stream may have a moisture content anywhere between 1 percent and 62 percent, or between 27 percent and 62 percent. To form a finished board using paper and plastic materials from these sources, moisture must be removed from the board materials. Moisture can be removed after disintegration (e.g., processing, shredding, milling, granulating, flaking, etc. the paper and plastic to form fragments) and before pressing, and/or during the hot pressing of the board. However, disintegration of paper and plastic above a certain moisture level may result in a pulpy mass rather than a desired loose collection of fragments, and may result in inferior mechanical properties in the finished boards. In the embodiments described herein, the raw material is dried prior to disintegration, rather than after disintegration, so that the proper fragments are formed and the boards have acceptable material properties. The raw material may be dried to a moisture content of 30 percent or less (e.g., below 31 percent) prior to disintegration.

Referring now to FIG. 1, an example composite board 100 is shown, in accordance with some embodiments of the present disclosure. Composite board 100 may be manufactured to operate as a roof cover board that can provide impact protection (from hail, foot traffic, and/or heavy equipment), temporary water resistance, fire resistance, wind-uplift constraint, thermal dimensional stability, and/or flexibility that is often required in roofing applications. Composite board 100 may be manufactured such that mechanical fasteners can be used to couple composite board 100 to other components (e.g., a wood frame) and/or such that adhesives can be used to adhere other components to the outer surfaces of composite board 100.

The composite board 100 may comprise three discrete layers, a top surface layer 102, a bottom surface layer 104, and a core layer 106. Top surface layer 102 and bottom surface layer 104 may be made from glass fiber fabrics, including nonwoven fiberglass mat. The top surface layer 102 and bottom surface layer 104 may also comprise paper, including kraft paper and synthetic polymer films or nonwovens, especially those having a melt-point greater than about 300 degrees Fahrenheit, such as nylon, polyester, and certain polyether-based films or nonwovens. In some embodiments, the top surface layer 102 and the bottom surface layer 104 may be about 0.005-0.100 inches thick.

Core layer 106 may be about 0.100-1.500 inches thick and may comprise discrete cellulosic elements and plastic elements, which may be connected through the use of a thermoplastic bonding resin, such as polyethylene. The cellulosic and plastic elements may be in the form of small pieces called fragments. The plastic elements may include a mixture of thermoset plastics, which do not melt, and thermoplastics. Thermoplastic elements can include polyethylene, polypropylene, copolymers of ethylene and propylene, polystyrene, acrylonitrile, styrene butadiene resins, and plasticized polyvinyl chloride. The size and shape of the plastic elements can vary substantially. However, in most cases, the size of the plastic elements will be less than that of the eventual composite panel that is being manufactured. Thermoplastic elements can include plastic fragments. Core layer 106 may be manufactured by heating and cooling a mat of discrete paper fragments and plastic fragments while applying pressure to the mat. The heat may melt the thermoplastic fragments, which then resolidify upon cooling.

Plastic fragments may be comprised of polypropylene, polystyrene, polyester, nylon, rubber (natural and synthetic), polyvinyl chloride, polyethylene (including LLDPE, LDPE, MDPE, HDPE), copolymers of ethylene and propylene, and other commercial plastics. Polyethylene based plastics, especially low and medium density polyethylene resins, may be used. The plastic fragments may be a mixture of different types of polymers. In addition to polymers, the core layer 106 can also contain plasticizers, such as dioctyl phthalate or benzyl butyl phthalate, colorants, stabilizers, preservatives, and other functional additives. Plastic fragments may be produced by disintegration (e.g., processing, shredding, milling, granulating, flaking, etc.) larger pieces of plastic. The plastic may be recycled or sourced from waste streams (films, packaging, or a wide array of plastic articles). Generating plastic fragments from waste or recycling streams has the advantage of being low cost and helps to sustainably reduce waste, which is a worldwide problem.

The core layer 106 may also include cellulosic elements. Cellulosic elements can include wood, cotton, grass (including bamboo), pulp fibers derived from various plants, rayon fibers, cellulose esters and other derivatives, paper, and other cellulose-based materials. Cellulosic elements may include paper fragments. Paper fragments may be made by milling larger pieces of paper until the disintegrated material passes through a screen with a particular mesh size. Paper subjected to the disintegration process may be newspaper, advertising, office paper, packaging, or other paper products. The paper may be recycled or sourced from waste streams. Generating paper fragments from waste or recycling streams has the advantage of being low cost and helps to sustainably reduce waste, which is a worldwide problem. In some embodiments individual fragments could contain both paper and plastic. For example, many packaging materials found in waste streams are comprised of a plurality of alternating paper and plastic layers. In some cases, these packaging materials may also include a layer of aluminum foil or a film that has been metalized on one surface. Fragments derived from all of these materials may be suitable for embodiments of this disclosure.

In some embodiments, composite board 100 may include a layer of thermoplastic adhesive between the core layer 106 and each surface layer 102, 104. The thermoplastic adhesive may bond the surface layers 102, 104 to the core when the board is heated and cooled. In some embodiments, the core layer 106 may include multiple layers of discrete paper fragments and plastic fragments.

The structure of composite board 100 may be designed to achieve compression load support, sudden impact resistance, wind uplift resistance, fastener retention, adhesive compatibility, temporary rain protection, low flame spread, thermal dimensional stability, and an exceptional level of mechanical flexibility. The design promotes rapid and easy installation of the cover board in a commercial low slope roof application. It may be especially advantageous in re-roofing applications due to its level of flexibility, which may allow it to more easily conform to the curved contour of the perimeter region of the roof. The upper (when installed) outer surface of the board may allow for the absorption of adhesives but may temporarily resist transfer of rainwater into the core layer of the board. It should be understood that while the examples described herein relate to the manufacture of composite boards, other goods may be manufactured using similar processes. These products may include drywall, wallboard, construction sheeting, exterior or interior sheathing, paper, cardboard, signage, boxes, shipping containers, etc.

Figure 2:
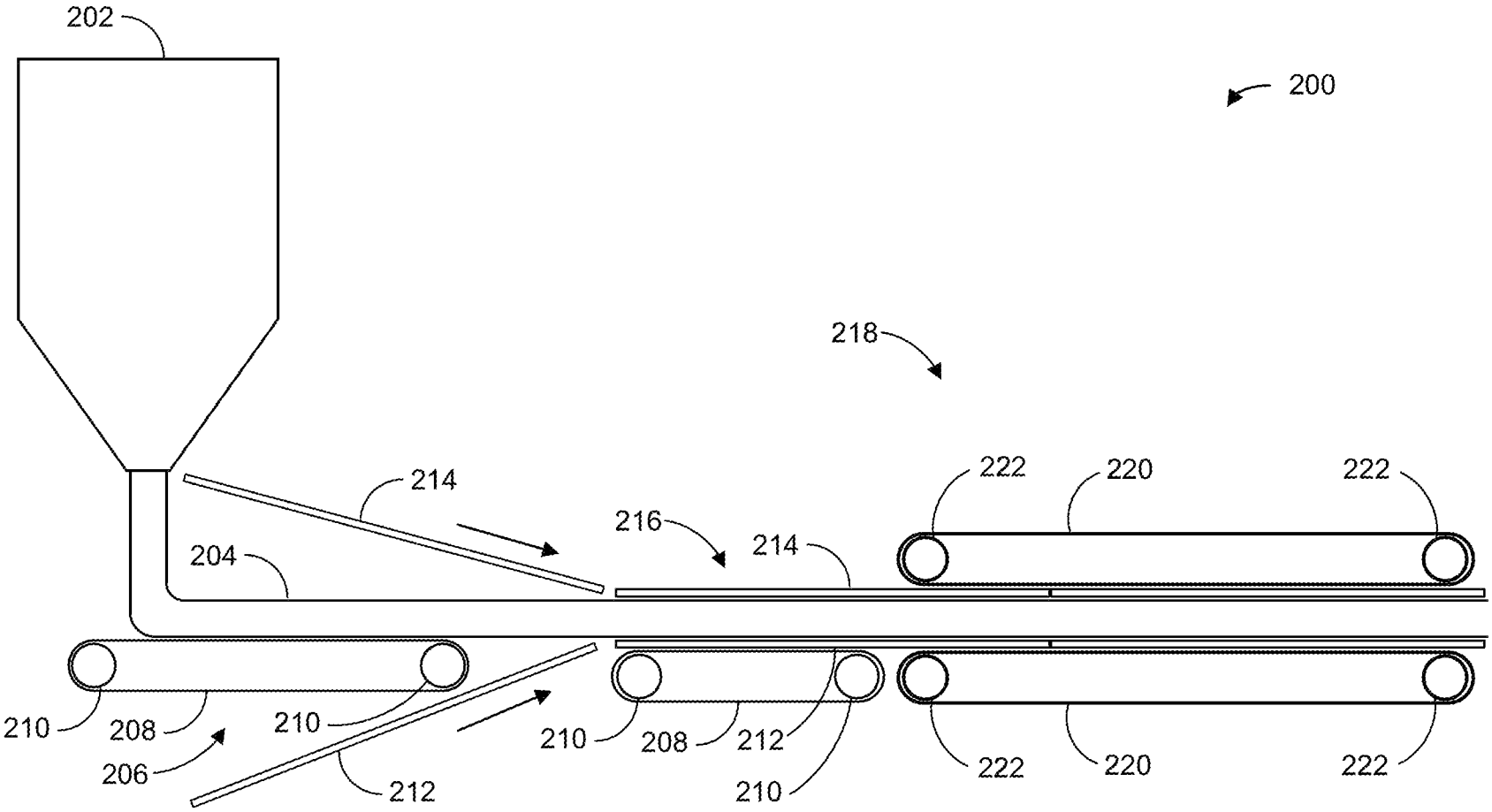
FIG. 2 is a side view illustration of a portion of a composite board manufacturing system, in accordance with some embodiments of the present disclosure.

Referring now to FIG. 2, a composite board manufacturing system 200 is shown, in accordance with some embodiments of the present disclosure. It should be understood that the various components of the composite board manufacturing system 200 are not to scale. Further, certain components in the system, including cooling and cutting components, are not shown. Composite board manufacturing system 200 may include a forming bin 202 configured to receive a mixture of plastic and paper and to dispense a continuous mat 204 of paper and plastic onto a conveyor system 206. The continuous mat 204 may be heated, pressed, and cut to form the core layer 106 of the composite board 100. The conveyor system 206, may include one or more belts 208 arranged end to end, each belt 208 travelling around two or more rollers 210. One or more of the rollers 210 may be driven, for example, by a motor or engine. The conveyor system 206 moves the continuous mat 204 through the various stages of manufacturing of the composite board 100. As used herein, the term "downstream" refers to the direction that the conveyor system 206 moves the continuous mat 204, and the term "upstream" refers to a direction opposite the direction that the conveyor system 206 moves the continuous mat 204. Lower facers 212 may be inserted from underneath the conveyor system 206 such that the lower facers 212 are positioned between the continuous mat 204 and the conveyor belt 208. In some embodiments, the lower facers 212 may be positioned on the conveyor system 206 upstream of the forming bin 202, such that the continuous mat 204 is deposited directly onto the lower facers 212. Upper facers 214 may be positioned on top of the continuous mat 204 to form a composite sandwich 216 including the continuous mat 204 sandwiched between the lower facers 212 and the upper facers 214. Thus, when the continuous mat 204 is pressed, cooled, and cut, a lower facer 212, or a portion of a lower facer 212, may form the bottom surface layer 104 of the composite board 100. The upper facer 214, or a portion of the upper facer 214, may form the top surface layer 102 of the composite board. In some embodiments, only the upper facers 214 or only the lower facers 212 may be added, such that the finished composite board 100 does not include either a top surface layer 102 or a bottom surface layer 104. In some embodiments, the mat of paper and plastic that is pressed to form the core layer 106 may not be continuous. For example, the core layer 106 material may be deposited on to the conveyor belt 208 with periodic interruptions if needed for manufacturability.

After the lower facers 212 and/or the upper facers 214 are positioned respectively underneath and on top of the continuous mat 204, the conveyor system 206 may move the composite sandwich 216 to a hot press assembly 218. The hot press assembly 218 may include heated belts 220, each travelling around two or more rollers 222 in a continuous circuit, positioned above and below the composite sandwich 216. One or more of the rollers 222 may be driven, for example, by a motor or engine. In some embodiments, the heated belts 220 may be made of steel. The heated belt 220 may be heated to a temperature in the range of about 350 degrees Fahrenheit to about 480 degrees Fahrenheit. A heating element (e.g., a resistive heating element, an inductive heating element, etc.) may be placed in contact with or in proximity to the heated belt 220 to heat the heated belt 220 to the desired temperature. For example, a resistive heating element may be positioned between the upper and lower segments of each heated belt 220 or adjacent the segment of the heated belt 220 not in contact with the composite sandwich 216. In some embodiments, one or more of the rollers 222 may include heating elements, and heat may be transferred from the rollers 222 to the heated belts 220. The system 200 may include temperature sensors to measure the temperatures of the heated belts 220. The measurements can be used to control the heating elements to maintain the heated belts 220 at the desired temperature. The heated belts 220 and rollers 222 may function similarly to the conveyor system 206, with the rollers 222 being configured to drive the heated belts 220 to move the composite sandwich 216 continuously through the hot press assembly 218. At the same time, the heated belts 220 and rollers 222 apply heat and high pressure to melt the plastic in the continuous mat 204 and compress the composite sandwich 216. In some embodiments, there may be only one heated belt 220 either above or below the composite sandwich 216, with the other side of the composite sandwich 216 not being heated. In these embodiments, a non-heated belt (e.g., similar to conveyor belt 208) may be used to apply pressure, but not heat, to the opposite side of the composite sandwich. After the composite sandwich 216 exits the hot press assembly 218, the composite sandwich 216 can be cooled (e.g., in a cold press) and cut into various shapes and sizes.

Figure 3A:
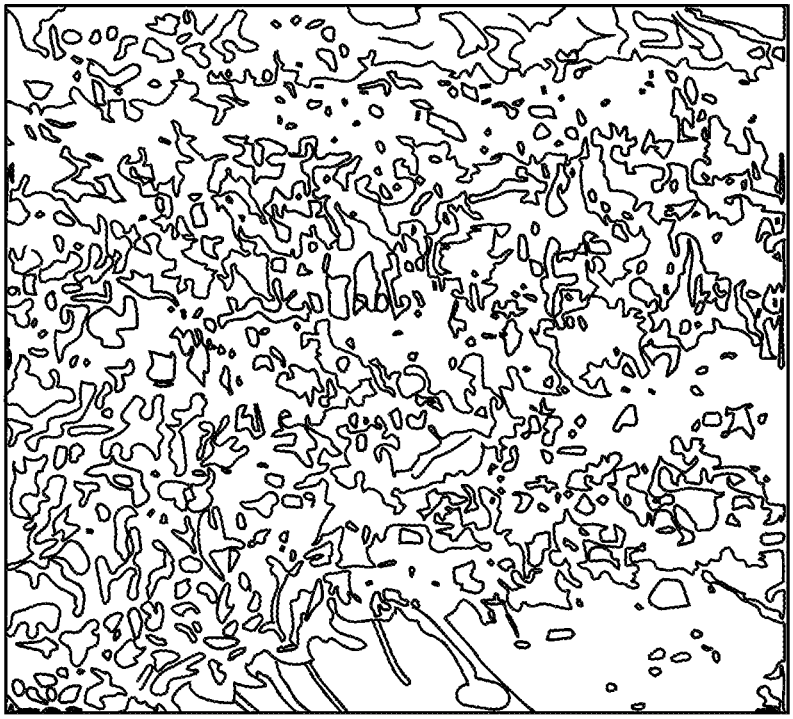
FIG. 3A is an image of paper and plastic that has been disintegrated while having a high moisture content.
Figure 3B:
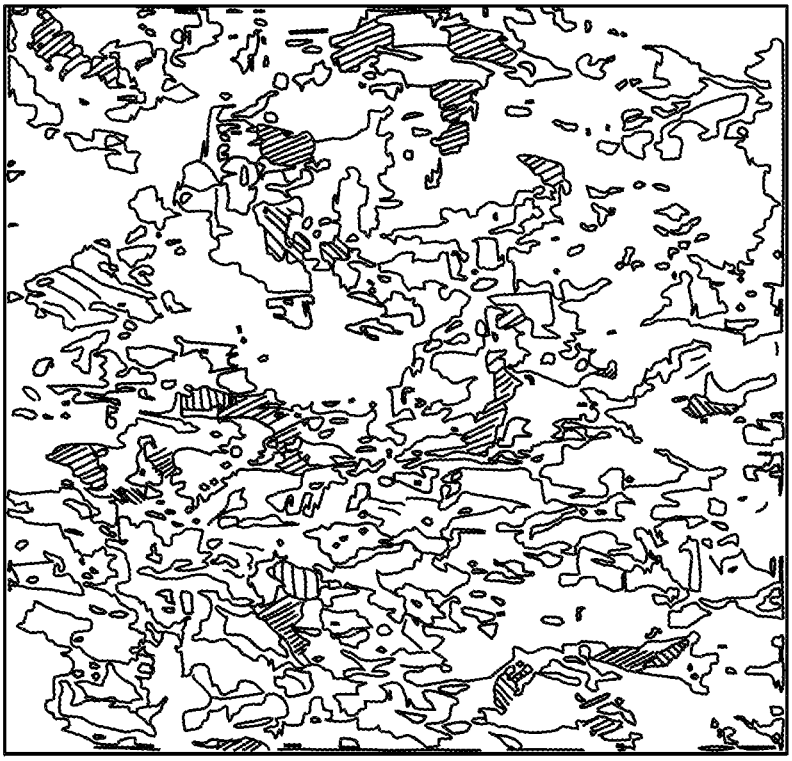
FIG. 3B is an image of paper and plastic that has been disintegrated while having a low moisture content.
Figure 4A:
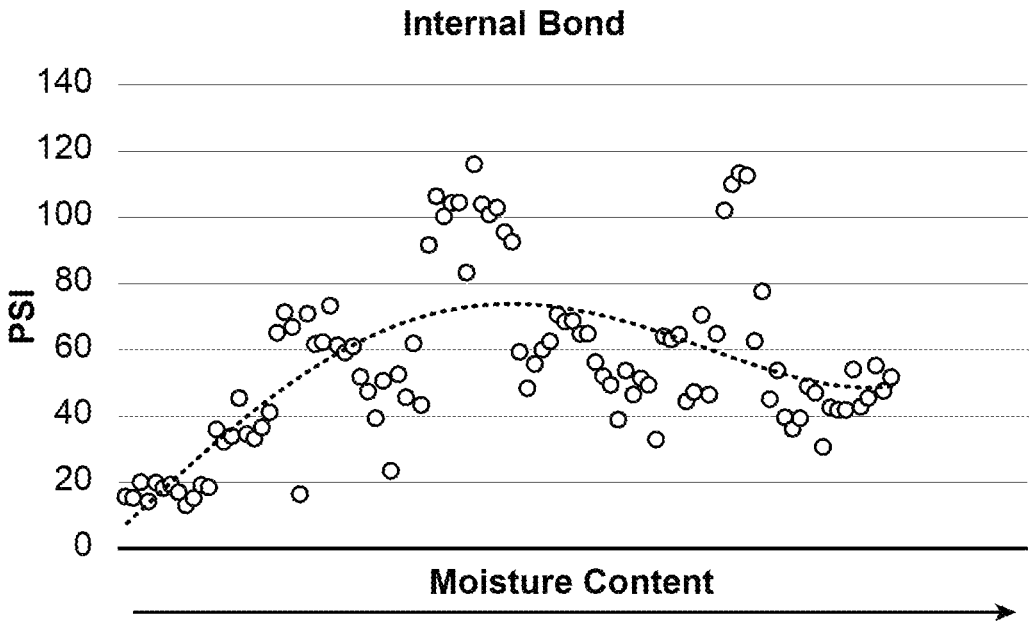
FIG. 4A is a graph illustrating the relationship of moisture content of pre-disintegrated paper and plastic to internal bond strength of a finished product.
Figure 4B:
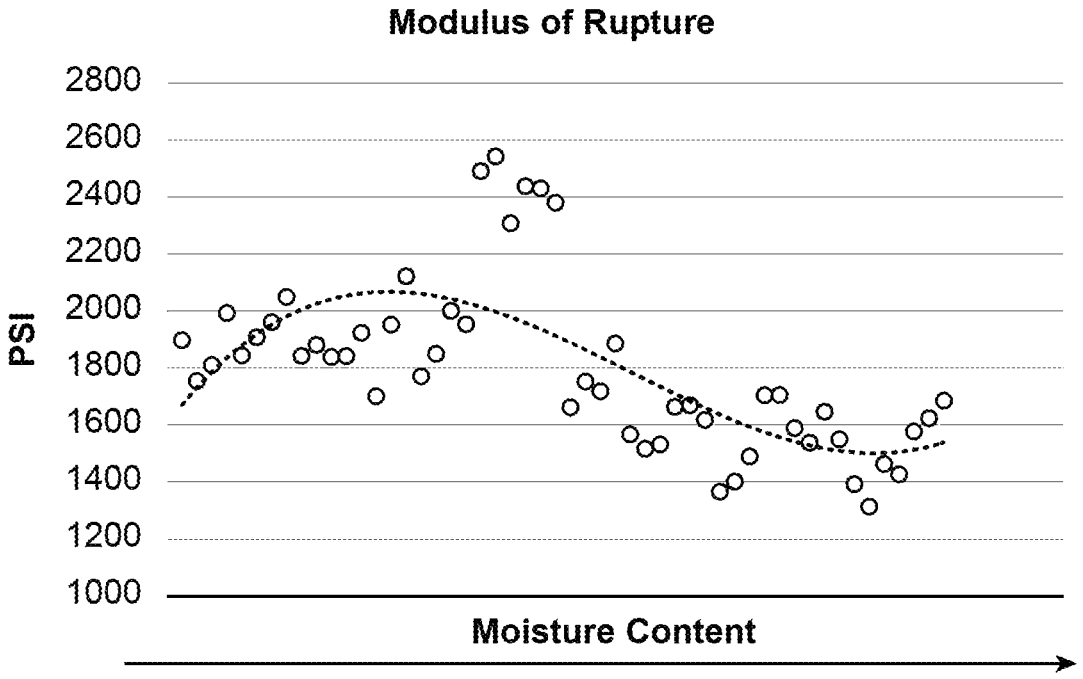
FIG. 4B is a graph illustrating the relationship of moisture content of pre-disintegrated paper and plastic to modulus of rupture of a finished product.
Figure 5A:
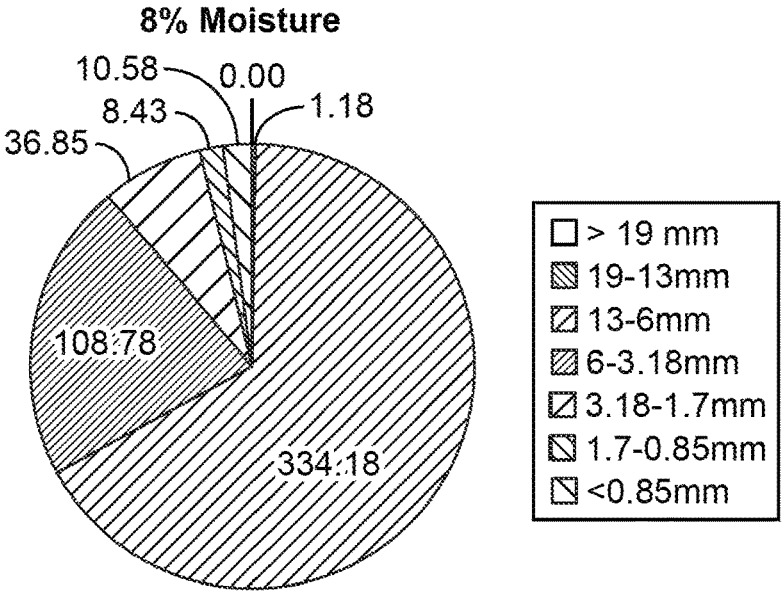
FIGS. 5A-5C are graphs illustrating the size distribution of paper and plastic fragments generated using paper and plastic material having different moisture contents.
Figure 5B:
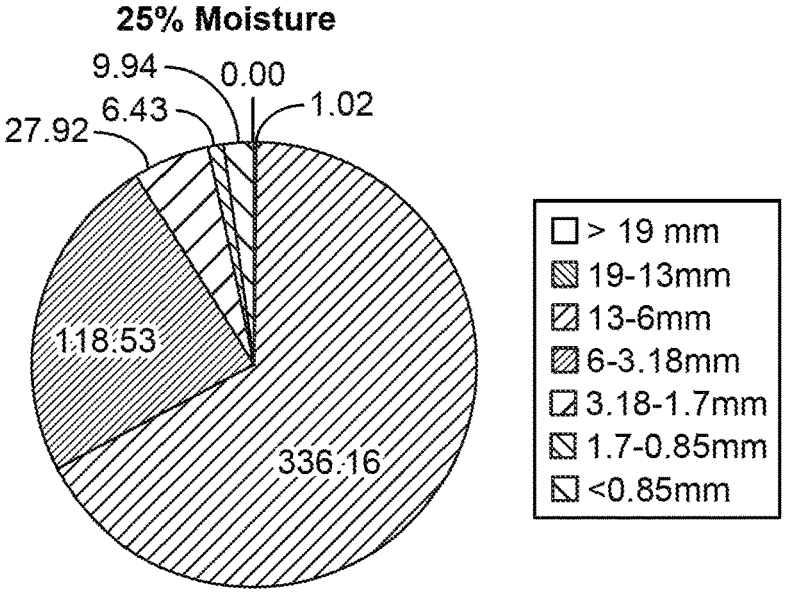
Figure 5C:
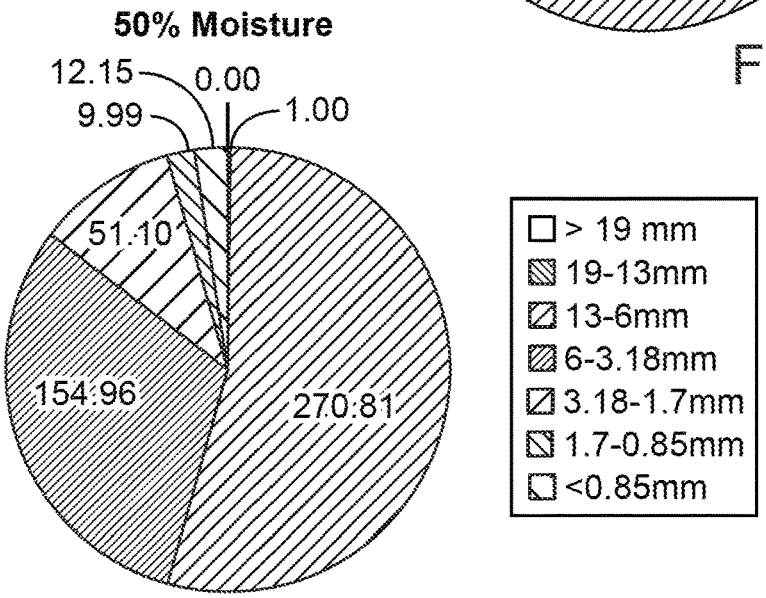

As discussed above, it may be advantageous to dry the raw paper and plastic material before disintegrating the material into fragments and dispensing the fragments from the forming bin 202. FIGS. 3A and 3B are respectively images of paper and plastic that has been disintegrated with a high moisture content (e.g., more than 30 percent moisture content, 31 percent or higher moisture content, etc.) and a low moisture content (e.g., 30 percent or less moisture content, less than 31 percent moisture content, etc.). As can be seen in these images, the disintegrated high moisture content paper and plastic has formed a pulpy mass, while the disintegrated low moisture content paper and plastic has formed loose fragments or paper and plastic. FIGS. 4A and 4B are graphs respectively illustrating the relationship of internal bond strength and modulus of rupture of a manufactured board to the moisture content of the raw material used to produce the board (e.g., the raw material used to produce the core layer 106). As can be seen in each figure, at a certain maximum percentage of moisture content, additional moisture content in the raw paper and plastic prior to disintegration can result in decreasing internal bond strength and modulus of rupture. FIGS. 5A-5C illustrate the fragment size distribution, after disintegration, at 8 percent moisture content, 25 percent moisture content, and 50 percent moisture content, respectively. As can be seen in FIGS. 5A and 5B, the fragment size distribution at 8 percent moisture content and 25 percent moisture content is approximately equal, with about 67 percent of fragments being between 6 mm and 13 mm in size, and about 29 percent being between 1.7 mm and 6 mm in size. As can be seen in FIG. 5C, however, at 50 percent moisture content, the percentage of fragments being between 6 mm and 13 mm in size drops to about 54 percent, and the percentage of fragments between 1.7 mm and 6 mm in size increases to about 43 percent. This increase in smaller sized fragments may contribute to the reduction in internal bond strength and modulus of rupture of the finished board as moisture content of the raw materials increases. Accordingly, in some embodiments, the raw paper and plastic material may be dried prior to disintegration to achieve the desired fragment size distribution and the resulting properties of the finished boards.

Similarly, as shown in FIGS. 4A and 4, at a certain minimum percentage of moisture content, additional drying of the raw paper and plastic prior to disintegration can result in decreasing internal bond strength and modulus of rupture. Accordingly, it may be advantageous to disintegrate the raw paper and plastic with a moisture content above a certain minimum moisture content. For example, in some embodiments, the raw paper and plastic may be disintegrated at a moisture content above 10 percent, above 15 percent, above 20 percent, or above 25 percent. However, the quality of the finished boards may be improved by pressing the mat of paper and plastic fragments at a lower moisture content (e.g., below 10 percent, below 15 percent, below 20 percent, or below 25 percent). Accordingly, in some embodiments, the paper and plastic fragments may be dried a second time after disintegration but before pressing. For example, in some embodiments, the raw paper and plastic may be dried to a moisture content of between 10 percent and 31 percent before the raw paper and plastic is disintegrated. After disintegration, the paper and plastic fragments may be dried a second time to a moisture content below 10 percent, prior to pressing the mat 204 of paper and plastic into one or more boards.

Figure 6:
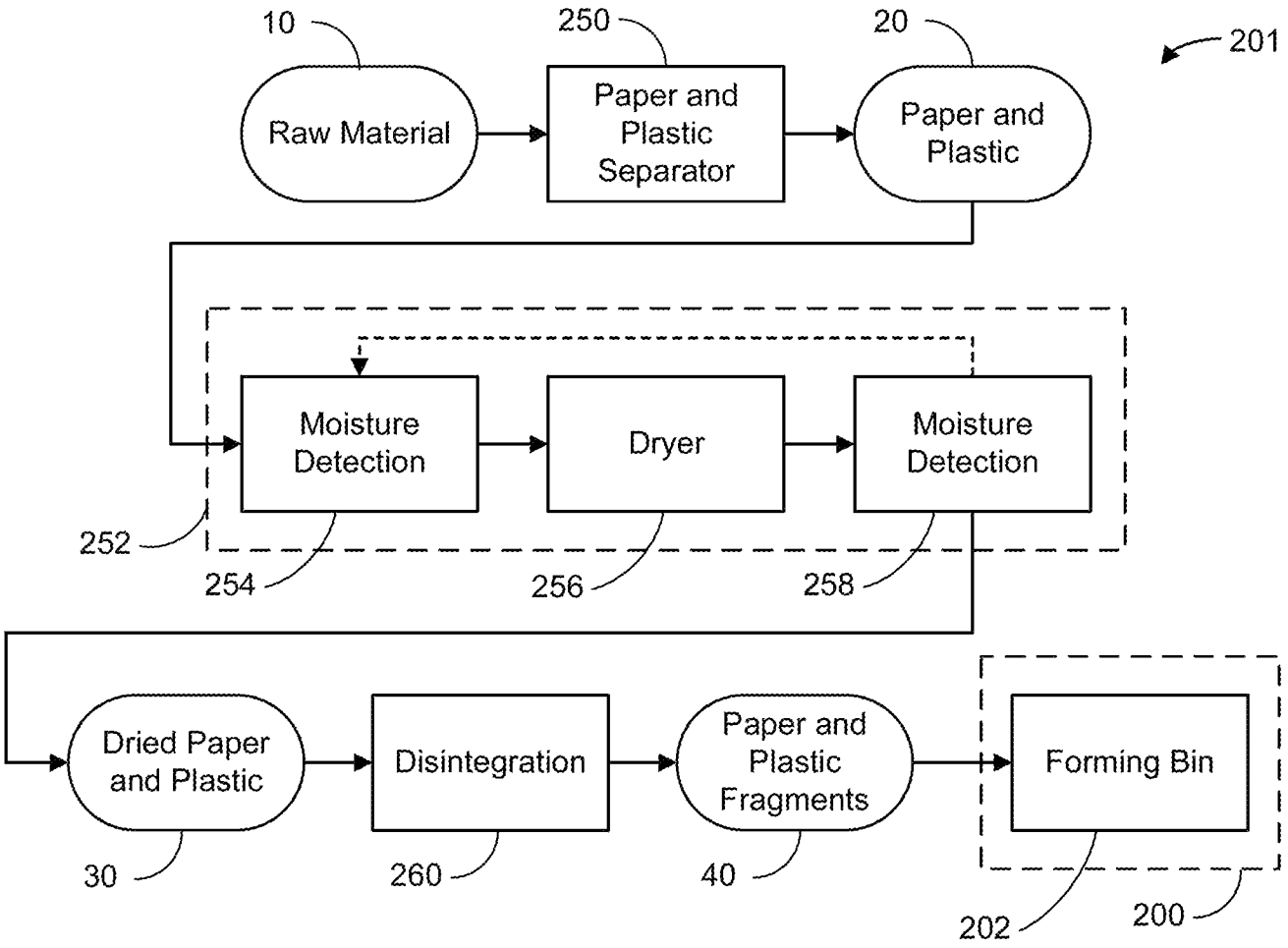
FIG. 6 is a schematic diagram of a fragment generation system, in accordance with some embodiments, in accordance with some embodiments of the present disclosure.

Referring now to FIG. 6, a schematic diagram of a fragment generation system 201 is shown, in accordance with some embodiments of the present disclosure. Raw material 10 (e.g., a raw material stream) is first fed to a paper and plastic separator 250. The raw material can include paper and/or plastic articles. The size of these articles can be about 2-12" in length or width. The size of the paper or plastic articles at this stage of the process could be influenced by preliminary disintegration steps. For example, there may be a pre-shredding step to reduce the size of larger large articles to about 2-12" in length or width. In some embodiments, the separator 250 may include an air classifier configured to separate the raw materials in the raw material 10 by weight and/or density and thereby produce a plurality of distinct streams. The air classifier may be a multi-step air classifier configured to separate heavy weight (or high density) materials in a first step. Lightweight and medium weight (or low or medium density) materials may be lifted by compressed air, while heavier materials are left behind. In a second step, medium weight materials may be separated from lightweight materials, and so on. Paper and plastic in the raw material stream 10 may be among the lightest or least dense materials in the raw material stream 10. In some embodiments, the separator 250 may include a magnet (e.g., an electromagnet) configured to extract ferrous materials from the raw material stream 10. In some embodiments, the separator may include a near infrared (NIR) spectroscopic sensor system, a hyperspectral imaging (HSI) system, or an optical sensor to identify certain components of the raw material stream 10. A precisely positioned burst of compressed air may be used to expel the detected material from the raw material stream 10. The separator 250 may then output a paper and plastic stream 20 comprising only paper and plastic, substantially only paper and plastic, or primarily paper and plastic.

The paper and plastic stream 20 may then be directed to a drying system 252. In some embodiments, the drying system includes a first moisture sensor 254 configured to detect a moisture content of the paper and plastic stream 20. The paper and plastic stream 20 may be continuously delivered to the drying system 252. A moisture content for the delivered paper and plastic stream 20 may be measured by the moisture sensor 254. Sensor data (e.g., the measurements) from the moisture sensor 254 may be delivered to a controller 504 configured to determine the moisture content of the delivered paper and plastic stream from the sensor data. Next, the paper and plastic stream 20 may be directed to a dryer 256 of the drying system 252. The dryer 256 may include one or more of a rotary dryer, a flash tube dryer, an infrared belt dryer, or a fluidized bed dryer. The controller 504 may determine, based on the moisture content determined based on the measurements from the moisture senor 254, a set of dryer parameters for a dryer cycle performed by the dryer 256 to achieve a target moisture content. The parameters may include a mass flow rate at which paper and/or plastic materials pass through the dryer 256, a temperature at which air enters the dryer 256, an airflow rate through the dryer 256, a rotational speed of the dryer 256, or any other controllable parameter of the dryer 256. The parameters determined by the controller 504 may also be based on additional factors, including the volume of the dryer, the size of the paper and plastic articles, the ratio of paper to plastic, the types of paper and/or plastic in the paper and plastic stream 20, and/or the initial temperature of the paper and plastic stream 20 as it enters the dryer. The controller 504 may send instructions to the dryer 256 to dry the batch of paper and plastic 20 using the determined parameters. The dryer 256 may then execute the instructions, performing a drying operation using the determined parameters. If the sensor data from the first moisture sensor 254 indicates that the moisture content of the paper and plastic stream 20 is already at or below the target moisture content, the paper and plastic stream 20 may bypass the dryer 256 and be sent directly to the disintegration system 260. As discussed above, the particle size distribution of the paper and plastic fragments may be dependent on the moisture content of the paper and plastic stream when it is disintegrated. A moisture content above the target moisture content may result in an undesirable particle size distribution that may result in a finished board with a lower modulus of rupture and internal bond strength. The target moisture content may thus be determined based on a desired fragment size distribution. The target moisture content may be below 31 percent to produce finished boards with desirable mechanical properties.

The dryer 256 can also be operated using a dryer cycle that ensures that at least a minimum amount of moisture is left in the paper and plastic stream, especially in the paper articles. While the target moisture content of the paper and plastic stream exiting the dryer may be less than about 31 percent, the target moisture content may also be greater than about 10 percent, 15 percent, 20 percent, or even 25 percent. As shown in FIG. 4, there can be significant mechanical property advantages in the finished panel by disintegrating the paper and plastic under conditions of elevated moisture content, as long as the moisture content of the stream is less than about 31 percent. The target moisture content used to determine the parameters of the dryer cycle may be a target moisture content range rather than a maximum moisture content. For example, the target moisture content range may be between 10 percent and 31 percent, between 15 percent and 31 percent, between 20 percent and 31 percent, or between 25 percent and 31 percent. A paper and plastic stream falling within the target moisture content range may produce fragments with a desired size distribution after the stream is disintegrated in the disintegration system 260.

When the dryer cycle is complete, the moisture content of the paper and plastic 20 may be measured by a second moisture sensor 258. Sensor data from the second moisture sensor 258 may be delivered to the controller 504, and the controller 504 may determine, based on the sensor data, whether the paper and plastic is below target moisture content or within the target moisture content range. If the second moisture sensor 258 detects a moisture content that is above the target moisture content or above the upper limit of the target moisture content range, the batch of paper and plastic 20 may be returned to the first moisture sensor 254, and the controller 504 may determine a new set of parameters for a second dryer cycle based on the new sensor data from the first moisture sensor 254 and/or the sensor data from the second moisture sensor. This process may be repeated as necessary until the paper and plastic 20 is below the the target moisture content or within the target moisture content range. In some embodiments, the controller 504 may adjust the parameters based on historical sensor data. For example, if repeat dryer cycles are required more than 50 percent of the time, the controller 504 may increase the drying time and/or drying temperature for the first dryer cycles of subsequent batches of paper and plastic 20. If, based on the sensor data from the second moisture sensor 258, the controller 504 determines that the moisture content of the paper and plastic 20 meets or is below the target moisture content or falls within the target moisture content range, the drying system 252 may output a dried paper and plastic stream 30. In some embodiments, sensor data from the first moisture sensor 254 may be used by the controller 504 to perform the post-drying moisture-detection step to determine if the target moisture content has been achieved. For example, the drying system 252 may not include a separate moisture sensor 258 for post-drying measurements, and the first moisture sensor 254 may perform both pre-drying and post-drying measurements. In some embodiments, the moisture content of the paper and plastic 20 may be continuously or periodically measured while the dryer 256 is operating. The controller 504 may end the dryer cycle when the measured moisture content of the paper and plastic 20 is below the target moisture content or within the targe moisture content range. In some embodiments, if the moisture content of the paper and plastic 20 fall below a lower limit of a target moisture content range, the dried paper and plastic stream 30 may be mixed with undried paper and plastic to increase the moisture content of the dried paper and plastic stream 30 until the moisture content falls within the target moisture content range.

The dried paper and plastic stream 30 may be directed to a disintegration system 260, which may include shredders (e.g., ram-style single shaft shredders, swing arm style single shaft shredders, gravity fed dual shaft shredders, etc.) mills, granulators, flakers, screens, etc. configured to disintegrate the dried paper and plastic stream 30 into paper and plastic fragments with a desired size distribution. In some embodiments, the disintegration system 260 may have multiple stages configured to produce progressively smaller fragments. A screen may be positioned between each stage to prevent fragments larger than a mesh size of the screen from passing through to the next stage. The screens may control the fragment size distribution of the paper and plastic fragments. The disintegration system 260 may output a stream of paper and plastic fragments 40 with a desired size distribution. The stream of paper and plastic fragments 40 may then be directed to the forming bin 202 of the composite board manufacturing system 200, where the fragments 40 may form a continuous mat 204 that is pressed into a core layer 106 of a composite board 100.

The moisture content of the paper and plastic stream can impact the shape, structure, and/or other properties of the fragments that emerge from the disintegration system 260. In some embodiments, a drying the paper and plastic stream 20 to a moisture content between about 10 percent and about 30 percent during the disintegration process can result in a fragment size distribution that yield significantly improved mechanical properties in finished panels derived from the fragments. In some embodiments, disintegrating the paper and plastic 20 below a target moisture content (e.g., below 31 percent) or within a target moisture content range (e.g., between 10 percent and 31 percent) may result in a finished board with mechanical properties that exceed what would be expected solely based on the fragment size distribution. For example, a board made from paper and plastic that is dried to a moisture content below 31 percent before disintegration may have superior material properties than a board made from paper and plastic that has a moisture content above 31 percent during disintegration, even if the particle size distribution of the paper and plastic is the same in both cases.

As an example of the foregoing, a raw material stream 10 comprising municipal waste may be delivered to the fragment generation system 201. The raw material stream 10 may be directed to the paper and plastic separator 250, where an air classifier may remove heavy and medium weight material from the stream 10. The raw material stream 10 may also pass under a magnet that may capture any ferrous materials in the stream 10. The separator 250 may output a stream of paper and plastic 20 to the drying system 252. In the drying system 252, the first moisture sensor 254 may detect a moisture content of the paper and plastic stream 20 (e.g., a batch of paper and plastic 20) to be 60 percent. The controller 504 may determine that, based on the moisture content and mass of the batch 20, in order to reach a target moisture content of 30 percent or less, the batch of paper and plastic 20 should be dried by the dryer 256 for 60 minutes at 300 degrees Fahrenheit. The batch of paper and plastic 20 may then be directed to the dryer 256 and dried for the determined amount of time at the determined temperature. The second moisture sensor 258 may measure the moisture content of the paper and plastic 20 after the dryer cycle, and the controller 504 may determine that the target moisture content has not been achieved. The paper and plastic 20 may then be returned to the first moisture sensor 254. The first moisture sensor 254 may determine that the moisture content of the paper and plastic 20 is 35 percent. The controller 504 may determine that, based on the moisture content and mass of the batch 20, in order to reach a target moisture content of 30 percent, the batch of paper and plastic 20 should be dried by the dryer 256 for 10 additional minutes at 300 degrees Fahrenheit. The batch of paper and plastic 20 may again be directed to the dryer 256 and dried for the determined amount of additional time at the determined temperature. The second moisture sensor 258 may measure the moisture content of the paper and plastic 20 after the second dryer cycle, and the controller 504 may determine that the moisture content of the paper and plastic 20 is 28 percent and the target moisture content has been achieved. The dried paper and plastic 30 may then be output from the dryer system 252 and directed to the disintegration system 260. The disintegration system 260 may disintegrate the dried paper and plastic 30 into fragments 40 having a desired size distribution. The fragments 40 may be directed to the forming bin 202, which may form the fragments into a mat 204. The mat 204 may be compressed into a board 100 the composite board manufacturing system 200. In the example discussed above, data from the first moisture sensor 254 may be used to determine the parameters of the dryer cycle, and the data from the second moisture sensor 258 may be used as a check to confirm that the target moisture content has been reached. In other embodiments, the data from the second moisture sensor 258 may be used to determine dryer parameters for dryer cycles after the initial dryer cycle. In some embodiments, there may be multiple dryers 256 arranged in series and configured to perform successive dryer cycles. The drying system 252 may include a moisture sensor 244, 258 configured to measure the moisture content of the paper and plastic before the paper and plastic 20 enters the first dryer, between each dryer 256, and after the paper and plastic stream has been dried in the last dryer 256.

In some embodiments, the paper and plastic may be separated from each other and dried and disintegrated in separate streams before being recombined. It may be advantageous for the paper to have a different moisture content or fragment size distribution than the plastic, or for the ratio of paper to plastic in the finished boards to be different than the ratio of paper to plastic in the raw material stream. For example, the paper and plastic separator 250 may first remove the material other than paper and plastic form the raw material stream 10. Then, the paper and plastic separator 250 may separate the remaining paper from the remaining plastic. Next, the paper alone may be directed to the drying system 252. The moisture of the paper may be measured by the first moisture sensor 254 and the paper may be dried in the dryer 256 using parameters determined by the controller 504. After the dryer cycle, if the sensor data from the second moisture sensor 258 indicates that the target moisture content has been achieved, the dried paper may be output from the dryer system 252, disintegrated in the disintegration system 260 and stored as paper fragments.

Next, the plastic separated from the raw material stream 10 may be directed to the drying system 252. The moisture of the plastic may be measured by the first moisture sensor 254 and the plastic may be dried in the dryer 256 using parameters determined by the controller 504. After the dryer cycle, if the sensor data from the second moisture sensor 258 indicates that the target moisture content has been achieved, the dried plastic may be output from the dryer system 252, disintegrated in the disintegration system 260 and stored as plastic fragments. The target moisture content for the plastic may be different than (or the same as) the target moisture content for the paper. The fragment size distribution of the plastic may also be different than (or the same as) the fragment size distribution of the paper. After the paper and plastic has been dried and disintegrated, the paper fragments and stored plastic fragments may be combined in a desired ratio and directed to the forming bin 202. The desired ratio of paper to plastic may be different than the initial ratio before the paper and plastic are separated from each other. In some embodiments, the fragment generation system 201 may have two drying systems 252 and two disintegration systems 260 so that the separated paper and plastic can be dried and disintegrated in parallel (e.g., simultaneously).

In some embodiments, a paper stream or a paper and plastic stream might be dried to a moisture content between about 10 percent and about 30 percent, then processed through disintegration system 260 to achieve a desired fragment size distribution, and thereafter processed through a second dryer to achieve a moisture content that is less than about 10 percent. Such fragments can then be formed into a mat and consolidated in a hot press and cold press system to yield a sheet that can be cut into finished panels or boards with mechanical properties that may exceed expectations based on the particle size distribution alone.

Figure 7:
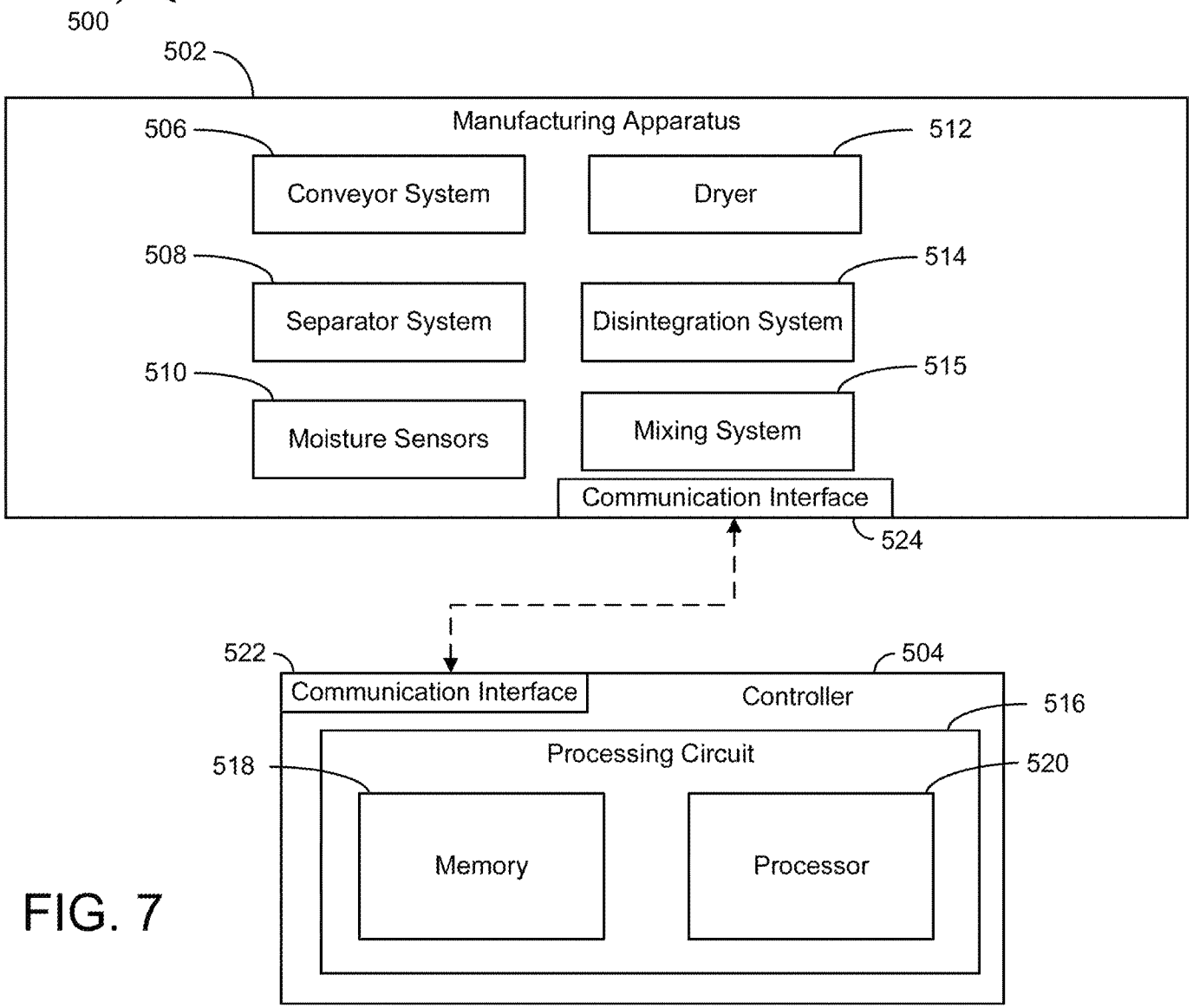
FIG. 7 is a block diagram of a fragment generation system, in accordance with some embodiments of the present disclosure

Referring now to FIG. 7, a block diagram of a fragment generation system 500 is shown, in accordance with some embodiments of the present disclosure. The fragment generation system 500 may be similar to the fragment generation system 201, shown and described with reference to FIG. 6. The fragment generation system 500 may include a manufacturing apparatus 502 and a controller 504. The controller 504 may be a component of manufacturing apparatus 502 (e.g., a processor and/or display coupled to the manufacturing apparatus 502) or may be external to the manufacturing apparatus 502. The manufacturing apparatus 502 may include a conveyor system 506, a separator system 508 (e.g., similar to the paper and plastic separator 250), moisture sensors 510 (e.g., similar to the moisture sensors 254, 258), a dryer 512 (e.g., similar to the dryer 256), a disintegration system 514 (e.g., similar to the disintegration system 260), and a fragment mixing system 515. Controller 504 may be configured to operate manufacturing apparatus 502 to manufacture paper and plastic fragments 40. The controller 504 may receive sensor data from the moisture sensors 510, via the communication interfaces 522, 524, that indicates the moisture content of a stream of paper and plastic and may determine operating parameters for the dryer 512 (e.g., parameters of a dryer cycle) necessary to reduce the moisture content to a target moisture content. The controller 504 may then instruct the dryer 512 via the communication interfaces 522, 524, to execute a dryer cycle using the determined parameters.

The controller 504 may include a processing circuit 516 and a communication interface 522. The processing circuit 516 may include a memory 518 and a processor 520, in some embodiments. The processing circuit 516 may be implemented as a general-purpose processor, an application specific integrated circuit ("ASIC"), one or more field programmable gate arrays ("FPGAs"), a digital-signal-processor ("DSP"), circuits containing one or more processing components, circuitry for supporting a microprocessor, a group of processing components, or other suitable electronic processing components. The processor 520 may include an ASIC, one or more FPGAs, a DSP, circuits containing one or more processing components, circuitry for supporting a microprocessor, a group of processing components, or other suitable electronic processing components. In some embodiments, the processor 520 may execute computer code stored in the memory 518 to facilitate the activities described herein. The memory 518 may be any volatile or non-volatile computer-readable storage medium capable of storing data or computer code relating to the activities. According to some embodiments, the memory 518 may include computer code modules (e.g., executable code, object code, source code, script code, machine code, etc.) for execution by the processor 520.

The communication interface 522 may communicate with a communication interface 524 of the manufacturing apparatus 502 via any synchronous or asynchronous network. The communication interface 522 may include one or more communication interfaces that can communicate with the components of the manufacturing apparatus 502. For example, the controller 504 may receive data from the moisture sensors 510 and/or control the conveyor system 506, the separator system 508, the dryer 512, the disintegration system 514, and the mixing system 515, via the communication interface 522. Based on such sensor data and via the communication interface 522, the controller 504 may transmit signals to the manufacturing apparatus 502 or devices (e.g., actuators or controllers) that operate the individual components 506-515 to cause manufacturing apparatus 502 to receive a raw material stream 10, separate paper and plastic from the raw material stream 10, dry the paper and plastic 20, disintegrate the dried paper and plastic 30, and mix or blend the paper and plastic fragments 40 if the paper has been separated from the plastic.

For example, the controller 504 may send signals, via the communication interfaces 522, 524, to the conveyor system 506 causing the conveyor system 506 to move the various material streams 10, 20, 30, 40 through the system 500 for separating, drying, disintegrating, and mixing. The controller 504 may send signals, via the communication interfaces 522, 524, to the separator system 508 causing paper and plastic to be separated from the raw material stream 10. For example, the controller 504 may send signals to control an air classifiers to separate material in the raw material stream 10 based on mass and/or density. In some embodiments, the controller 504 may send signals to the separator system 308 to separate the paper from the plastic. The controller 504 may receive, via the communication interfaces 522, 524, sensor data from the moisture sensors 510 indicating the moisture content of the paper and plastic 20. The controller 504 may determine, based on the sensor data, a set of dryer parameters (e.g., drying time, drying temperature, etc.) required to dry the paper and plastic 20 to achieve a target moisture content. The controller 504 may send signals to the dryer 512 indicating the determined parameters. The dryer 512 may then execute a dryer cycle using the received parameters. The controller 504 may send a signal to the dryer 512 to release the paper and plastic material to the disintegration system 514. The controller 504 may send a signal to the conveyor system 506 to move the paper and plastic material from the dryer 512 to the disintegration system 514. The controller 504 may send signals to the disintegration system 514 indicating the desired fragment size distribution. The disintegration system 514 may adjust the disintegration equipment (e.g., shredders, screens, flakers, mills, etc.) to achieve the desired fragment size distribution received from the controller 504. If the paper and plastic are separately dried and disintegrated, the controller 504 may send signals to the mixing system 515 indicating a desired ratio of paper to plastic. The mixing system 515 may combine the paper and plastic fragments according to the desired ratio and may agitate the combination to mix the fragments until an even distribution is achieved.

Figure 8:
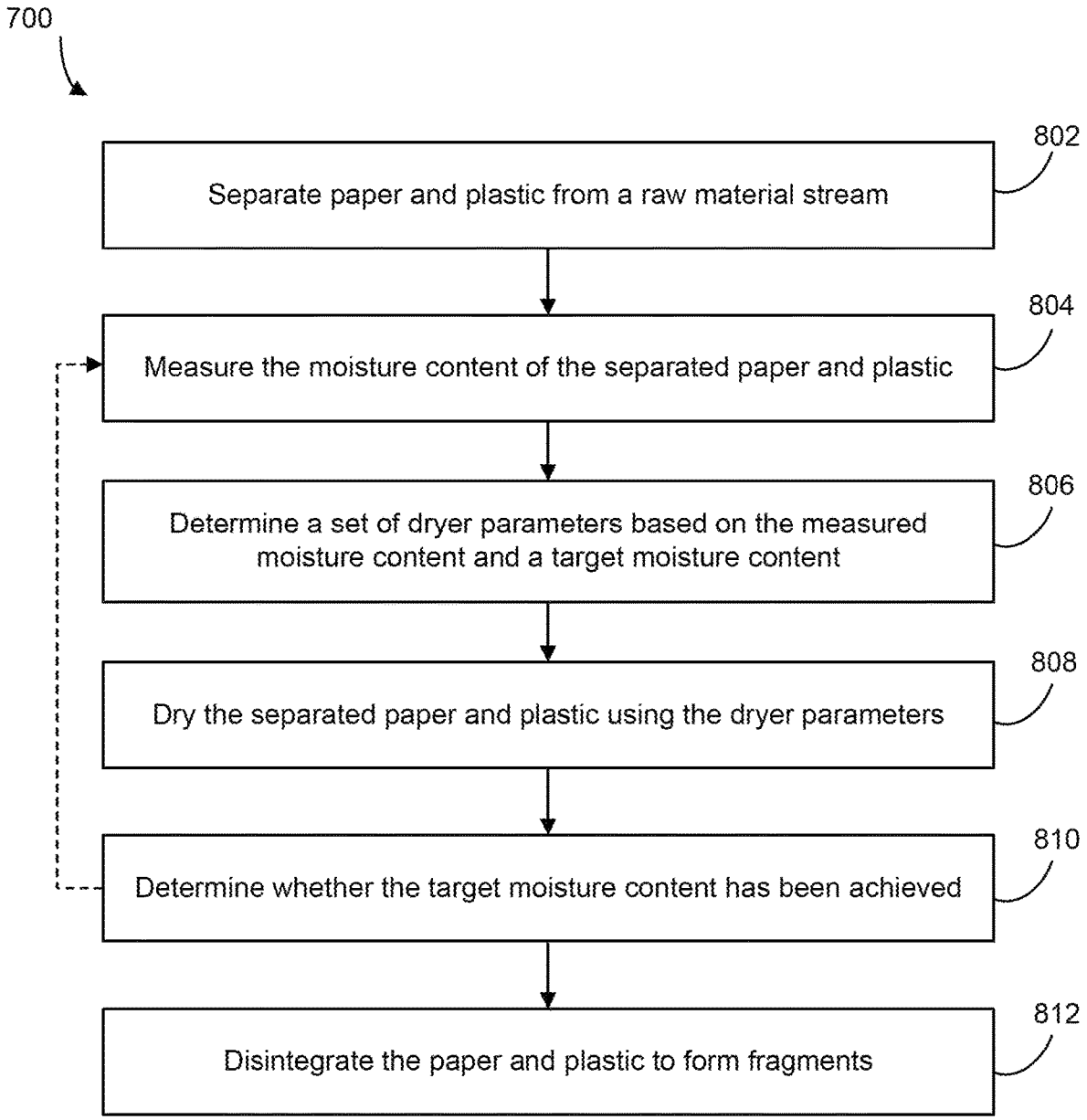
FIG. 8 is a flow diagram of an example process for generating paper and plastic fragments, in accordance with some embodiments of the present disclosure.

FIG. 8 is a diagram of an example process 800 for generating fragments, in accordance with some embodiments of the present disclosure. Process 800 can be performed using a fragment generation system (e.g., fragment generation system 201, 500), which may include a controller (e.g., controller 504). Process 800 may include more or fewer operations, and the operations may be performed in any order and may be repeated. Performance of process 800 may enable the fragment generation system 201, 500 to generate fragments from waste materials, which may be used to manufacture a composite board 100.

At operation 802 of the process 800, paper and plastic (e.g., a batch of paper and plastic material) may be separated from a raw material stream comprising other materials (metals, glass, food waste, etc.). Various equipment may be used to separate the paper and plastic from the other material in the raw material stream. For example, an air classifier may be used to separate the materials by weight and/or density. A magnet may be used to separate ferrous materials from non-ferrous materials. Sensors may be used to detect the material composition of articles in the stream, and compressed air may be precisely applied to remove articles of certain compositions. The equipment may output a stream that comprises only paper and plastic, substantially only paper and plastic, or primarily paper and plastic.

At operation 804 of the process 800, the moisture content of the separated paper and plastic may be determined. For example, sensor data from a first moisture sensor may be used to determine the moisture content of the paper and plastic. At operation 806 of the process 800, a set of one or more drying parameters may be determined based at least on the moisture content of the paper and plastic and a target moisture content. For example, the sensor data may indicate that the moisture content of the paper and plastic is 45 percent, and the target moisture content may be 30 percent. The dryer parameters may be determined such that a dryer cycle using the determined parameters may reduce the moisture content of the paper and plastic from 45 percent to 30 percent. The dryer parameters may include an amount of time the dryer should operate, a mass flow rate of paper and plastic material through the dryer, a temperature at which the dryer should operate, an amount of airflow through the dryer, a rotational speed of the dryer, or any other controllable parameter of the dryer. The determination of the set of dryer parameters may be additionally based on the type of dryer, the age of the dryer, the temperature of the paper and plastic, an air temperature as the paper and plastic enter the dryer, the ratio of paper to plastic, the mass of the paper and plastic, sizes of the pieces of paper and plastic as they enter the dyer and/or the types of paper and plastic. In some embodiments, the determination of the set of dryer parameters may be additionally based on historical data regarding the dryer, including the parameters required to dry previous similar streams of paper and plastic.

At operation 808 of the process 800, the paper and plastic may be dried in a dryer using the set of determined dryer parameters. The dryer may be, for example, a rotary dryer, a flash tube dryer, an infrared belt dryer, or a fluidized bed dryer. In some embodiments, multiple driers of the same type or of different types may be used in sequence or in parallel. At operation 810 of the process 800, it may be determined whether the target moisture content has been reached. For example, the moisture content of the paper and plastic may be measured a second time, either by the first moisture sensor or by a second moisture sensor. If the target moisture content has not been reached, operations 804-810 may be repeated, and the paper and plastic may be dried a second time. A new set of parameters may be determined based on the second moisture content measurement or based on a third moisture content measurement by the first moisture sensor. After the second dryer cycle, the moisture content may be measured a third or fourth time to determine whether the target moisture content has been achieved. If, at operation 810, it is determined that the moisture content of the paper and plastic is at or below the target moisture content, the paper and plastic may be disintegrated into a plurality of fragments at operation 812. The fragments may then be pressed into a composite board in a composite board manufacturing system. For example, a process for manufacturing a composite board may include operations 802-812 as well as additional operations including forming a mat comprised of the paper and plastic fragments produced in operation 812, compressing the mat using a heated press, cooling the mat using a cold press, and cutting the mat into a board. Notably, operations 802-810 may be performed before operation 812, such that a desired fragment size distribution and fragment consistency is achieved. This may result in a finished composite board with a higher internal bond strength and modulus of rupture compared to boards manufactured with fragments made from paper and plastic with a moisture content above the target moisture content.

In an aspect, a method of generating paper and plastic fragments using moisture content to control fragment size distribution and mechanical properties of a product made therefrom is provided. The method includes measuring a moisture content of a batch of paper and plastic material, drying the batch of paper and plastic material to achieve a target moisture content, and disintegrating the batch of paper and plastic material, after drying, to form a plurality of paper In some embodiments, the method further includes pressing the plurality of paper and plastic fragments into a board using a heated press.

In some embodiments, the method further includes determining a set of dryer parameters for a dryer used to dry the batch of paper and plastic material, the dryer parameters based on at least the measured moisture content and the target moisture content. In some embodiments, the set of dryer parameters includes at least one of an amount of time the dryer should operate, a temperature at which the dryer should operate, an amount of airflow through the dryer, a mass flow rate of the paper and plastic material through the dryer, or a rotational speed at which the dryer should operate. In some embodiments, the set of dryer parameters is further determined based on at least one of a mass of the batch of paper and plastic, an air temperature as the paper and plastic material enters the dryer, a volume of the batch of paper and plastic, sizes of pieces of the paper and plastic material as the pieces enter the dryer, a temperature of the batch of paper and plastic, a ratio of paper to plastic, a type of paper in the batch, or a type of plastic in the batch.

In some embodiments, the moisture content of the batch of paper and plastic material before drying is between 1 percent and 62 percent and wherein the target moisture content is less than 31 percent.

In some embodiments, the moisture content of the batch of paper and plastic material before drying is between 11 percent and 62 percent and wherein the target moisture content is greater than 10 percent and less than 31 percent. In some embodiments, the method further includes drying the batch of paper and plastic material to a second target moisture content after disintegrating the batch of paper and plastic material. In some embodiments, the second target moisture content is less than 10 percent.

In some embodiments, drying the batch of paper and plastic material comprises drying the batch of paper and plastic materials a first time and measuring the moisture content a second time to determine whether the dried paper and plastic material has reached the target moisture content. In some embodiments, drying the batch of paper and plastic further comprises drying the batch of paper and plastic fragments a second time upon determining that the target moisture content has not been reached after drying the paper and plastic materials the first time.

In some embodiments, drying the batch of paper and plastic material comprises separating paper from plastic in the batch of paper and plastic material and drying the paper separately from the plastic. In some embodiments, the target moisture content comprises a first target moisture content for the paper and a second target moisture content for the plastic. In some embodiments, the paper and the plastic are disintegrated separately to form a batch of paper fragments and a separate batch of plastic fragments, wherein the method further comprises mixing at least a portion of the batch of paper fragments with at least a portion of the batch of plastic fragments after disintegration.

In some embodiments, the method further includes determining the target moisture content based at least in part on a desired fragment size distribution.

In another aspect a system for generating paper and plastic fragments using moisture content to control fragment size distribution and mechanical properties of a product made therefrom is provided. The system includes a first moisture sensor configured to measure a moisture content of paper and plastic material, a dryer configured to dry the paper and plastic material, a disintegration system configured to receive and disintegrate the paper and plastic material to produce paper and plastic fragments and a controller. The controller includes a processor and a non-transitory computer readable storage medium comprising instructions stored thereon that, upon execution by the processor, cause the controller to receive sensor data from the first moisture sensor indicating the moisture content, determine a set of dryer parameters based on the moisture content and a target moisture content, send the set of dryer parameters to the dryer, wherein the dryer is configured to dry the paper and plastic material using set of the dryer parameters, determine that the paper and plastic material has achieved the target moisture content, and send a signal to the dryer to release the dried paper and plastic material to the disintegration system.

In some embodiments, the set of dryer parameters includes at least one of an amount of time the dryer should operate, a mass flow rate of the paper and plastic material through the dryer, a temperature at which the dryer should operate, a size of pieces of the paper and plastic material as the pieces enter the dryer, an amount of airflow through the dryer, or a rotational speed at which the dryer should operate.

In some embodiments, the dryer is one of a rotary dryer, a flash tube dryer, an infrared belt dryer, or a fluidized bed dryer.

In some embodiments, the set of dryer parameters is further determined based on at least one of a mass of the batch of paper and plastic, an air temperature as the paper and plastic material enters the dryer, a volume of the batch of paper and plastic, a temperature of the batch of paper and plastic a ratio of paper to plastic, a type of paper in the batch, or a type of plastic in the batch.

In some embodiments, the disintegration system includes at least one of a ram style single shaft shredder, a swing arm style single shaft shredder, a gravity fed dual shaft shredder, a mill, a granulator, or a flaker.

In some embodiments, the disintegration system further includes one or more screens configured to control a fragment size distribution of the fragments.

In some embodiments, determining that the paper and plastic material has achieved the target moisture content comprises receiving sensor data from one of the first moisture sensor or a second moisture sensor.

In some embodiments, the instructions, upon execution by the processor, further cause the controller to determine the target moisture content based at least in part on a desired fragment size distribution.

While this specification contains specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable sub-combination. Moreover, although features may be described as acting in certain combinations and even initially claimed as such, one or more features from a claimed combination can, in some cases, be excised from the combination, and the claimed combination may be directed to a sub-combination or variation of a sub-combination.

As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A method of generating paper and plastic fragments using moisture content to control fragment size distribution and mechanical properties of a product made therefrom, the method comprising:

measuring, by a moisture sensor positioned immediately upstream of a disintegration system, a moisture content of a batch of paper and plastic material after a first drying operation, wherein the batch has a moisture content between about 10 percent and about 31 percent;

drying, in a second drying operation, the batch of paper and plastic material in a dryer operated according to one or more parameters determined by a controller based on the measured moisture content, to achieve a target moisture content, wherein the target moisture content is a range less than 31 percent and greater than about 10 percent and is determined based at least in part on a desired fragment size distribution; and disintegrating the batch of paper and plastic material, after said second drying operation, to form a plurality of paper and plastic fragments having a predetermined fragment size distribution, wherein moisture content outside the range prior to disintegration produces a pulpy mass and reduced internal bond strength and modulus of rupture in boards produced therefrom.

2. The method of claim 1, further comprising pressing the plurality of paper and plastic fragments into a board using a heated press.

3. The method of claim 1, further comprising determining a set of dryer parameters for the dryer, wherein the dryer is operated according to one or more parameters determined by a controller based on the moisture content measured after the first drying operation to dry the batch of paper and plastic material, the dryer parameters based on at least the measured moisture content and the target moisture content.

4. The method of claim 3, wherein the set of dryer parameters includes at least one of an amount of time the dryer should operate, a temperature at which the dryer should operate, an amount of airflow through the dryer, a mass flow rate of the paper and plastic material through the dryer, or a rotational speed at which the dryer should operate.

5. The method of claim 3, wherein the set of dryer parameters is further determined based on at least one of a mass of the batch of paper and plastic, an air temperature as the paper and plastic material enters the dryer, a volume of the batch of paper and plastic, sizes of pieces of the paper and plastic material as the pieces enter the dryer, a temperature of the batch of paper and plastic, a ratio of paper to plastic, a type of paper in the batch, or a type of plastic in the batch.

6. The method of claim 1, wherein the moisture content of the batch of paper and plastic material before drying is between 1 percent and 62 percent.

7. The method of claim 1, wherein the moisture content of the batch of paper and plastic material before drying is between 11 percent and 62 percent and wherein the target moisture content is greater than 10 percent.

8. The method of claim 7, further comprising drying the batch of paper and plastic material to a second target moisture content after disintegrating the batch of paper and plastic material.

9. The method of claim 8, wherein the second target moisture content is less than 10 percent.

10. The method of claim 1, wherein drying the batch of paper and plastic material comprises drying the batch of paper and plastic materials a first time and measuring the moisture content a second time, by the moisture sensor positioned immediately upstream of the disintegration system, to determine whether the dried paper and plastic material has reached the target moisture content.

11. The method of claim 10, wherein drying the batch of paper and plastic further comprises drying the batch of paper and plastic fragments a second time upon determining that the target moisture content has not been reached after drying the paper and plastic materials the first time.

12. The method of claim 1, wherein drying the batch of paper and plastic material comprises separating paper from plastic in the batch of paper and plastic material and drying the paper separately from the plastic.

13. The method of claim 12, wherein the target moisture content comprises a first target moisture content for the paper and a second target moisture content for the plastic.

14. The method of claim 13, wherein the paper and the plastic are disintegrated separately to form a batch of paper fragments and a separate batch of plastic fragments, wherein the method further comprises mixing at least a portion of the batch of paper fragments with at least a portion of the batch of plastic fragments after disintegration.

* * * * *